US010730601B2

(12) United States Patent
Gartman

(10) Patent No.: US 10,730,601 B2
(45) Date of Patent: Aug. 4, 2020

(54) SELF-CONTAINED DEPTH COMPENSATED ACCUMULATOR SYSTEM

(71) Applicant: Allen Russell Gartman, El Lago, TX (US)

(72) Inventor: Allen Russell Gartman, El Lago, TX (US)

( * ) Notice: Subject to any disclaimer, the term of this patent is extended or adjusted under 35 U.S.C. 154(b) by 141 days.

(21) Appl. No.: 15/827,345

(22) Filed: Nov. 30, 2017

(65) Prior Publication Data

US 2018/0087538 A1 Mar. 29, 2018

Related U.S. Application Data

(63) Continuation-in-part of application No. 14/678,839, filed on Apr. 3, 2015, now Pat. No. 9,835,177.

(60) Provisional application No. 61/991,836, filed on May 12, 2014.

(51) Int. Cl.

| | |
|---|---|
| ***F15B 1/16*** | (2006.01) |
| ***B63H 25/12*** | (2006.01) |
| ***E21B 43/01*** | (2006.01) |
| ***E21B 33/035*** | (2006.01) |
| ***F15B 21/00*** | (2006.01) |
| ***F15B 1/04*** | (2006.01) |

(52) U.S. Cl.

CPC ..... *B63H 25/12* (2013.01); *E21B 33/0355* (2013.01); *E21B 43/01* (2013.01); *F15B 1/04* (2013.01); *F15B 21/006* (2013.01); *F15B 2201/22* (2013.01)

(58) Field of Classification Search

CPC ..... F15B 2201/315; F15B 2201/3151–3153; F15B 2201/3155; F15B 2201/22; F15B 2201/405; F15B 1/16

See application file for complete search history.

(56) References Cited

U.S. PATENT DOCUMENTS

| | | | | |
|---|---|---|---|---|
| 4,166,478 A * | 9/1979 | Sugimura | F15B 1/10 | 138/30 |
| 6,789,577 B2 * | 9/2004 | Baltes | F15B 1/165 | 138/30 |
| 7,520,129 B2 * | 4/2009 | Springett | E21B 33/0355 | 60/398 |

(Continued)

*Primary Examiner* — F Daniel Lopez

(74) *Attorney, Agent, or Firm* — Nolte Intellectual Property Law Group

(57) ABSTRACT

A self-contained expandable automatic pressure compensated accumulator system for storing and releasing hydraulic fluid energy for use by subsea equipment having a controller, a pressure source, a bidirectional valve fluidly connected to the pressure source, an expandable multisided vessel fluidly connected to the bidirectional valve having a plurality of axial folds between first and second ends, and a bidirectional port connected to the pressure source. As the plurality of axial folds expand, a contracted volume of pressure expands increasing stored hydraulic fluid energy in the expandable multisided vessel. As the plurality of axial folds contract, the expanded volume reduces, releasing stored hydraulic fluid energy to nearby subsea equipment on demand as changes in hydraulic fluid energy requirements for the subsea equipment changes. Simultaneously, hydrostatic seawater pressure of seawater on the expandable multisided vessel is counteracted with the hydrostatic pressure of fluid inside the expandable multisided vessel.

5 Claims, 9 Drawing Sheets

(56) References Cited

U.S. PATENT DOCUMENTS

2013/0019746 A1* 1/2013 Engelberg ..... F15B 1/16
92/130 R

* cited by examiner

FIG. 4A
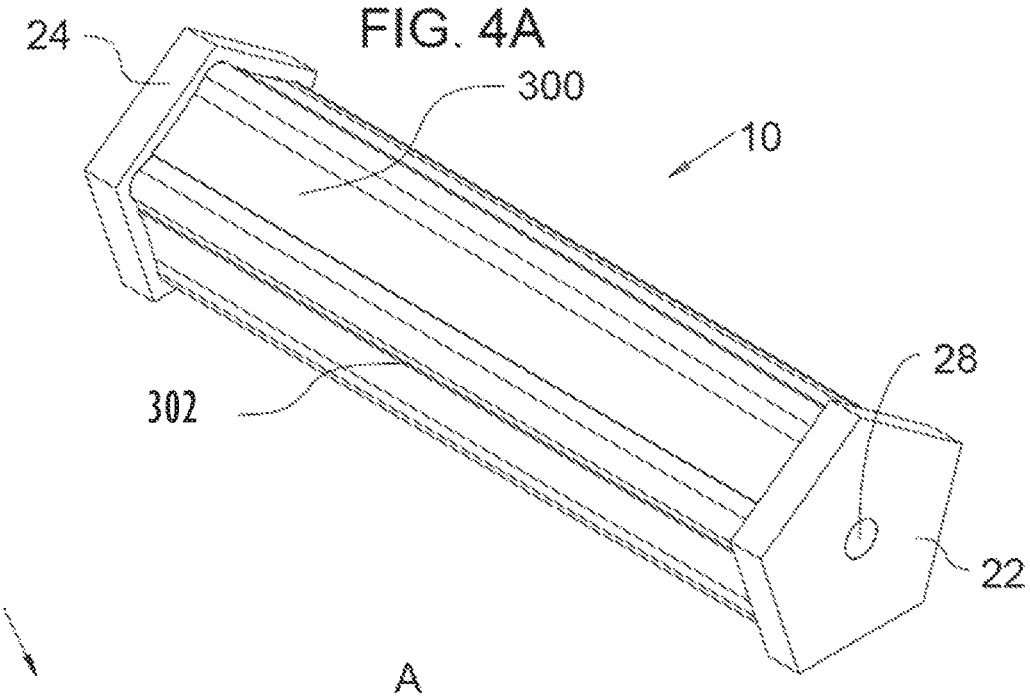
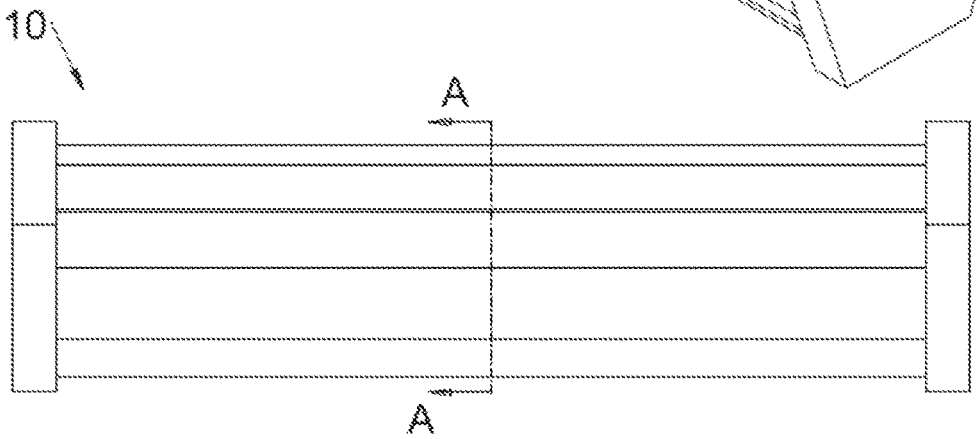
FIG. 4B
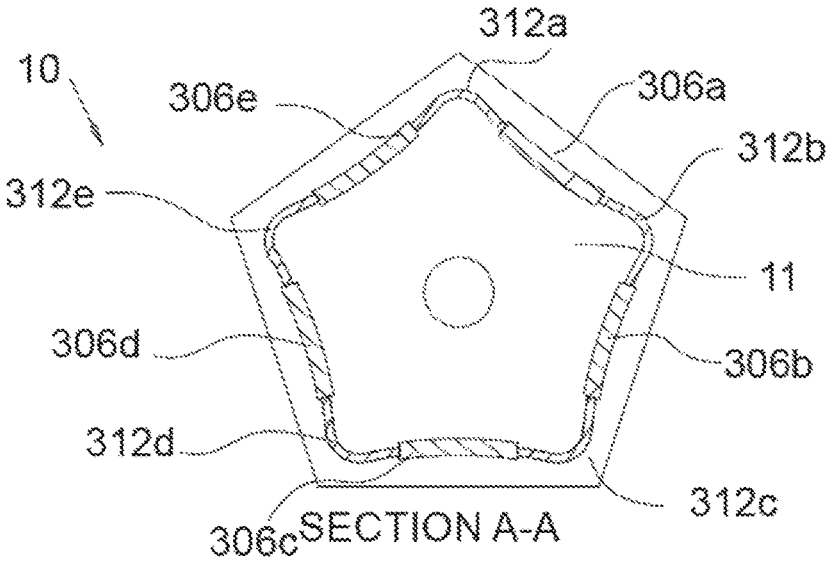
FIG. 4C

FIG.5A
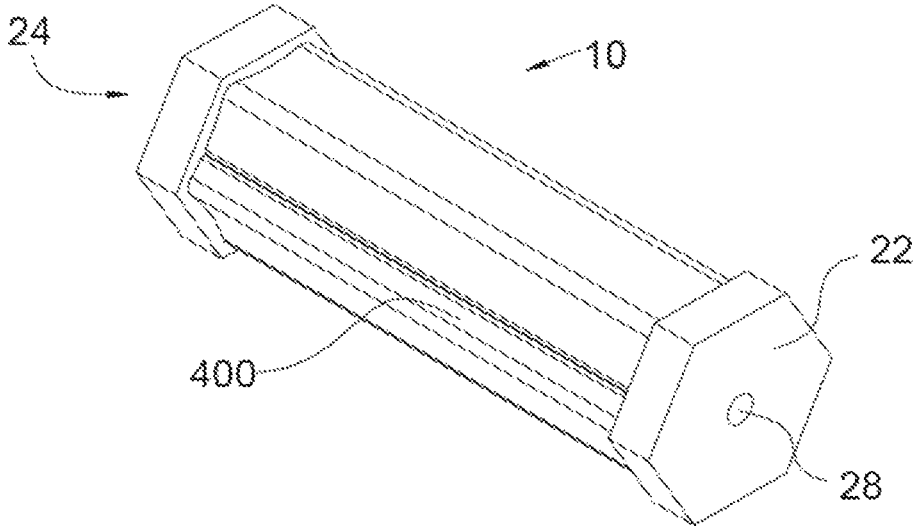
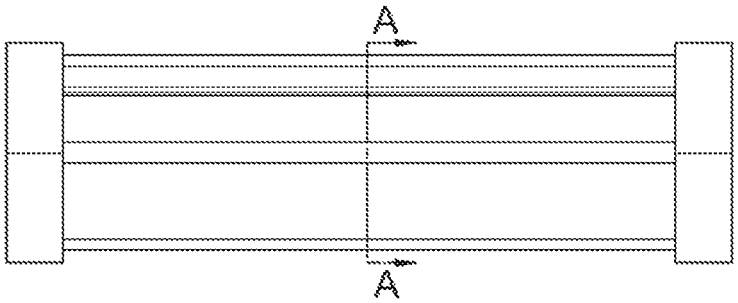
FIG.5B
FIG. 5C
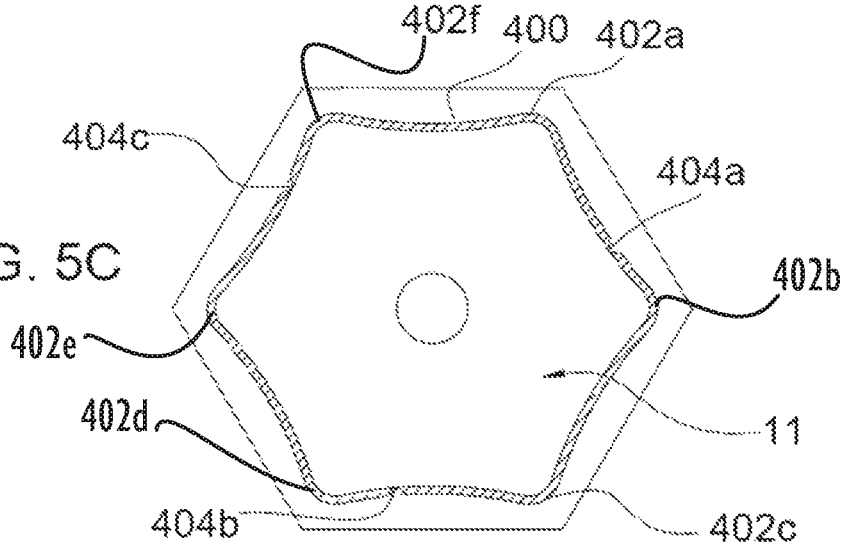
SECTION A-A

SECTION A-A

SELF-CONTAINED DEPTH COMPENSATED ACCUMULATOR SYSTEM

CROSS REFERENCE TO RELATED APPLICATION

The current application claims is a Continuation In Part and claims priority to and the benefit of co-pending U.S. patent application Ser. No. 14/678,839 filed Apr. 3, 2015, entitled "SELF-CONTAINED DEPTH COMPENSATED ACCUMULATOR SYSTEM" and U.S. Provisional Patent Application Ser. No. 61/991,836 filed on May 12, 2014, entitled "SELF-CONTAINED DEPTH COMPENSATED ACCUMULATOR SYSTEM." These references is hereby incorporated in its entirety.

FIELD

The present embodiments generally relate to a subsea accumulator acting as a hydraulic fluid energy storage device for a hydraulic power system.

BACKGROUND

A need exists for a simple accumulator for subsea hydraulic power systems that operates through supply tubes at great distances, some as long as 120 miles from a hydraulic pressure source and at subsea depths as deep as 15,000 feet below sea level.

A need exists for an accumulator which is not spring charged, as when the spring fails, an undetectable loss of hydraulic fluid energy storage occurs.

A need exists for an accumulator which is not piston based because when piston seals leak the hydraulic fluid teaks into the sea.

A need exists for an accumulator usable at deep ocean depths, more than 5,000 feet, which is flexibly constructed and behaves like a spring without being spring charged.

The present embodiments meet these needs.

BRIEF DESCRIPTION OF THE FIGURES

The detailed description will be better understood in conjunction with the accompanying drawings as follows:

FIGS. 4A, 4B and 4C depict another embodiment of the expandable multisided vessel in a partially expanded configuration.

FIGS. 5A, 5B and 5C depict another embodiment of the expandable multisided vessel in a partially expanded configuration according to one or more embodiments.

Figure 1:
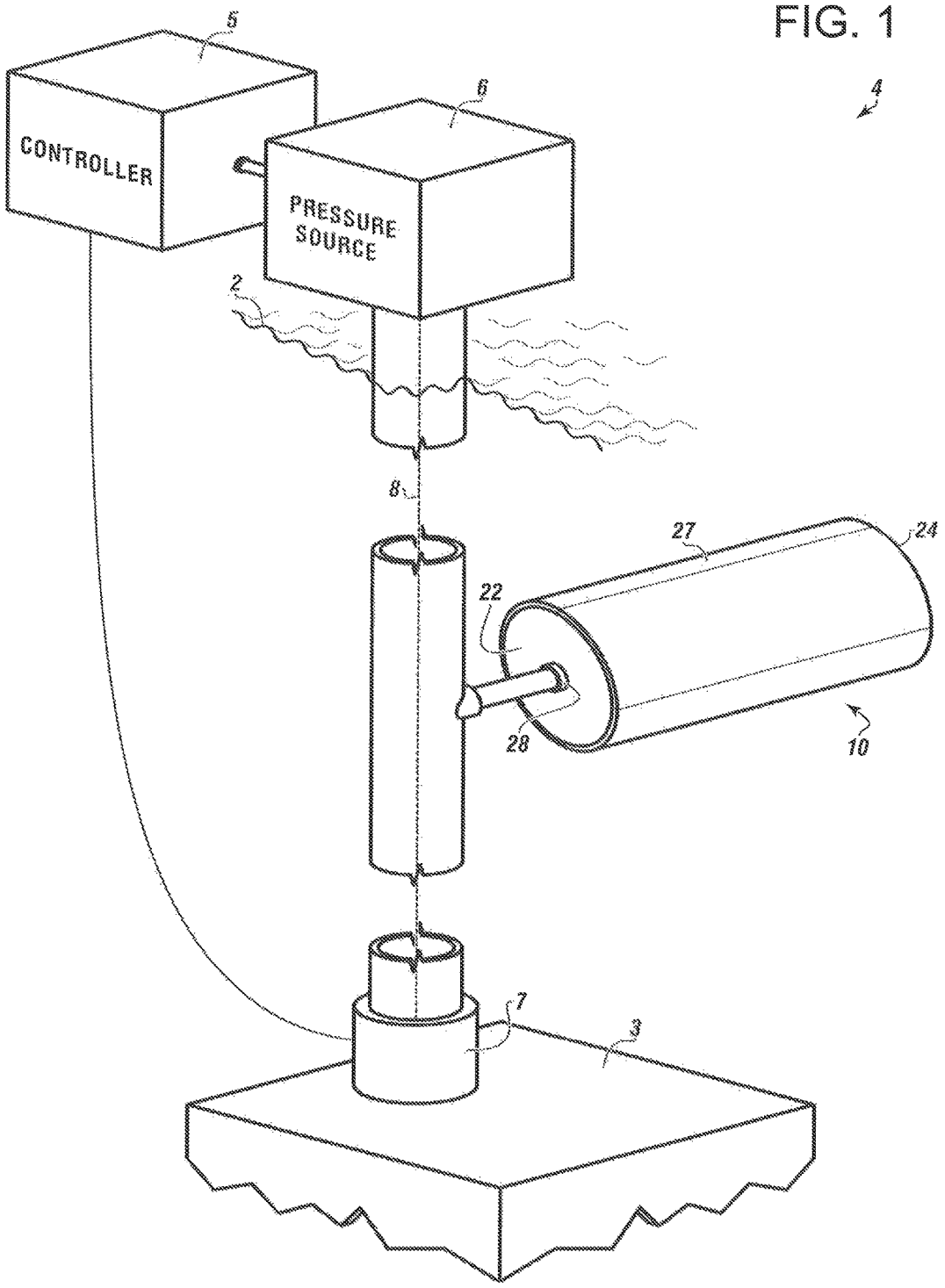
FIG. 1 depicts a diagram of the system with an expandable multisided vessel in a fully expanded configuration according to one or more embodiments.

The present embodiments are detailed below with reference to the listed Figures.

DETAILED DESCRIPTION OF THE EMBODIMENTS

Before explaining, the present apparatus and system in detail, it is to be understood that the apparatus and system is not limited to the particular embodiments and that it can be practiced or carried out in various ways.

The present embodiments relate to a subsea accumulator that is depth compensated.

The present embodiments relate to an accumulator for subsea use that can have no piston to stick and cause undetected loss of hydraulic fluid energy storage.

The present embodiments relate to an accumulator that can have no piston seals to leak and cause undetected loss of hydraulic fluid energy polluting the sea.

The present embodiments relate to an accumulator that can have no spring to fail and cause undetected loss of hydraulic fluid energy storage. The loss of hydraulic fluid energy causes loss of subsea equipment which could cause wells to erupt causing pollution and damage to wildlife.

The embodiments relate to a flexible accumulator that can have a moveable flexible outer wall that reacts against the hydrostatic pressure of sea water as variable pressure/volume load can be applied to the flexible accumulator.

The term "bidirectional valve" as used herein can refer to a solenoid operated valve, such as a shuttle valve, a gate valve, a ball valve, a butterfly valve, another three way valve, or another at least two way valve capable of withstanding subsea pressures between the subsea equipment and the expandable multisided vessel, such as from 1,500 psi to 20,000 psi.

The term "commands" as used herein can refer to electronic signals that contain at least one bit of information and instruct the bidirectional valve to change state, such as to open or close, communicating user intent to the bidirectional valve. Commands can be transmitted from a controller to the bidirectional valve.

The term "contracted pressurized volume" as used herein can refer to a hydraulic fluid volume when the pressure source provides the hydraulic fluid at a zero pressure, when the axial folds of the expandable multisided vessel are in an initial folded position, the pressure inside the chamber of the expandable multisided vessel equals hydrostatic pressure of the hydraulic fluid at the depth of the expanded vessel.

The term "controller" as used herein can refer to a surface or subsea device adapted to open or close the bidirectional valve of the embodiments using an electric or electronic signal. The controller can open or close the valve based on needs of subsea equipment for hydraulic fluid energy. In embodiments, the controller can be a computer or a programmable logic circuit with computer instructions in the data storage and a processor connected to the data storage.

The term "expanded pressurized volume" as used herein can refer to a hydraulic fluid volume when the pressure source provides the hydraulic fluid at an operating pressure, when the axial folds of the expandable multisided vessel are in an expanded position, the pressure inside the chamber of the expandable multisided vessel equals hydrostatic pressure of the hydraulic fluid at the depth of the expanded vessel plus the operating pressure.

The term "hydraulic fluid" as used herein can refer to oils, water, or another mixture of liquid chemicals, such as corrosion preventive chemicals, which can be pressurized to form hydraulic fluid energy.

The term "hydraulic fluid energy" as used herein can refer to a hydraulic fluid volume which has been pressurized forming hydraulic energy.

The term "pressure source" as used herein can refer to a hydraulic fluid source, such as a tank of hydraulic fluid volume and a pressure pump at sea level which supplies hydraulic fluid energy to the expandable multisided vessel. In embodiments, the pressure pump can operate from 1,500 psi to 20,000 psi.

The term "subsea equipment" as used herein can refer to equipment that can be installed and operating under water, at depths from 30 feet to 20,000 feet and can include but is not limited to blow out preventers, manifolds, Christmas trees, conduits, tubulars, flow line systems, subsea cleaning devices, remotely operated vehicles (ROV) and subsea processing systems.

The embodiments further relate to a self-contained expandable automatic pressure compensated accumulator system for storing and releasing hydraulic fluid energy for use by subsea equipment.

The system can include a pressure source connected to the controller for supplying hydraulic fluid at a defined pressure as "hydraulic fluid energy".

The system can include a bidirectional valve connected fluidly to the pressure source for transmitting hydraulic fluid energy to subsea equipment.

The bidirectional valve can be electrically connected to the controller for controlling hydraulic fluid energy to and from the subsea equipment based on commands from the controller.

The system can include an expandable multisided vessel fluidly connected to the bidirectional valve.

The expandable multisided vessel can have a first end and a second end. The expandable multisided expandable multisided vessel can have a longitudinal axis between the first end and the second end.

The expandable multisided vessel can have a plurality of axial folds formed contiguously between the first end and the second end creating an outer wall of the expandable multisided vessel.

In embodiments, a pressure containing chamber can be formed between the plurality of axial folds and the first and second ends.

The pressure containing chamber can be configured to have a contracted pressurized volume and an expanded pressurized volume.

The expandable multisided vessel can have a bidirectional port formed in the first end or in the second end. In embodiments, the bidirectional port can be formed along the longitudinal axis.

The bidirectional port can connect simultaneously and in parallel to the pressure source and the bidirectional valve.

The bidirectional port can be configured to provide a flow of hydraulic fluid energy to the bidirectional valve from the pressure containing chamber and a flow of hydraulic fluid energy to the pressure containing chamber from the pressure source.

The embodiments operate so that when the plurality of axial folds expand away from the longitudinal axis, the contracted volume of the pressure containing chamber expands towards an expanded volume increasing stored hydraulic fluid energy in the pressurized chamber, and as the plurality of axial folds contract towards the longitudinal axis, the expanded volume of the pressurized chamber reduces, releasing stored hydraulic fluid energy, enabling the expandable multisided vessel to store retrievable subsea hydraulic fluid energy in close proximity to the subsea equipment and release the stored hydraulic fluid energy on demand as changes in hydraulic fluid energy requirements for the subsea equipment changes, while the expandable multisided vessel simultaneously counteracts the hydrostatic seawater pressure of seawater outside of the expandable multisided vessel with the hydrostatic pressure of hydraulic fluid inside the pressurized chamber.

In embodiments, the self-contained expandable automatic pressure compensated accumulator system can have an expandable multisided vessel with 3 folds to 20 folds.

In embodiments, the self-contained expandable automatic pressure compensated accumulator system supplies hydraulic power to subsea equipment. Examples of subsea equipment can include but is not limited to a blowout preventer, a tubular, a subsea Christmas tree, and a subsea manifold.

Turning now to the Figures, FIG. 1 depicts a diagram of the system with the expandable multisided vessel in a fully expanded configuration according to one or more embodiments.

The self-contained expandable automatic pressure compensated accumulator system 4 can include a pressure source 6 at the surface of water 2, which can be controlled by a controller 5 to provide hydraulic fluid 8 to a bidirectional port 28 formed in a first end 22 of an expandable multisided vessel 10.

The expandable multisided vessel 10 can have an outer wall 27 formed between the first end 22 and a second end 24.

The bidirectional port 28 can be connected to both the pressure source 6 and a bidirectional valve 7 that controls hydraulic fluid 8 that flows to subsea equipment 3.

The bidirectional port 28 not only provides a flow of hydraulic fluid 8 to the bidirectional valve 7 from the expandable multisided vessel 10 but can also provide a flow of hydraulic fluid 8 to the expandable multi sided vessel 10 from the pressure source 6.

The controller 5 can be in electronic communication with the bidirectional valve 7 and can communicate to the subsea equipment 3.

Figure 2A:
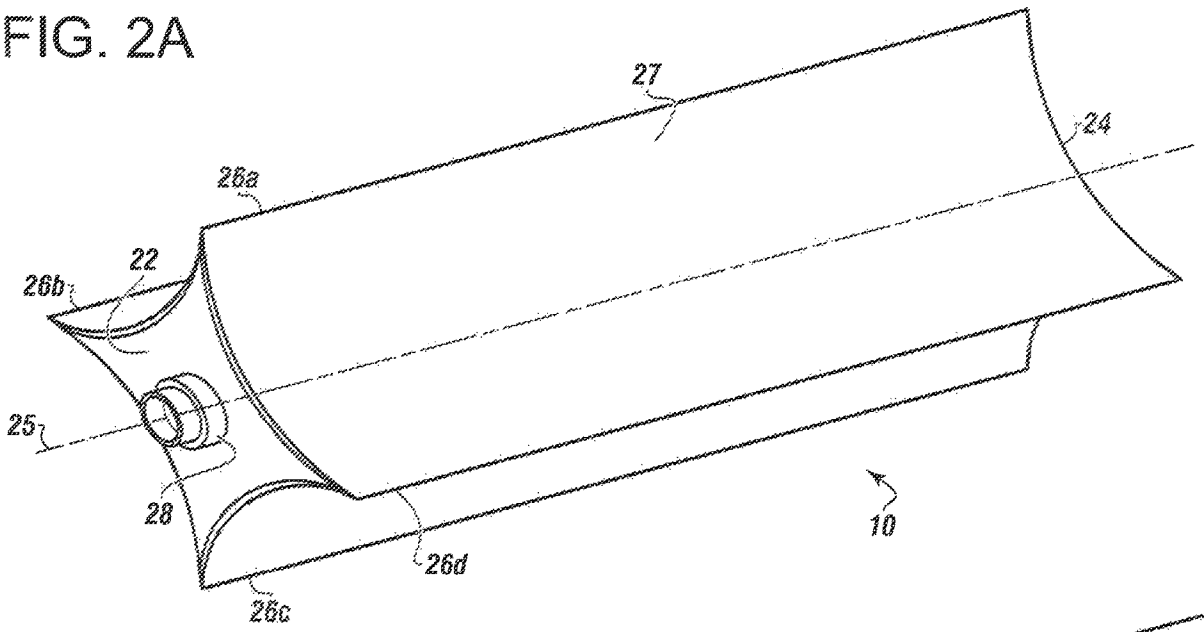
FIG. 2A depicts a top perspective view demonstrating the concept of an expandable multisided vessel in a fully contracted configuration according to one or more embodiments.

FIG. 2A depicts a top perspective view of the expandable multisided vessel 10 with a longitudinal axis 25 that passes through the bidirectional port 28 in a fully contracted configuration according to one or more embodiments.

In this embodiment, the bidirectional port 28 can be formed in the first end 22 of the contracted configuration.

In this configuration, a plurality of axial folds 26*a*, 26*b*, 26*c*, and 26*d* can be formed contiguously between the first end 22 and the second end 24 creating the outer wall 27 of the expandable multisided vessel 10.

Figure 2B:
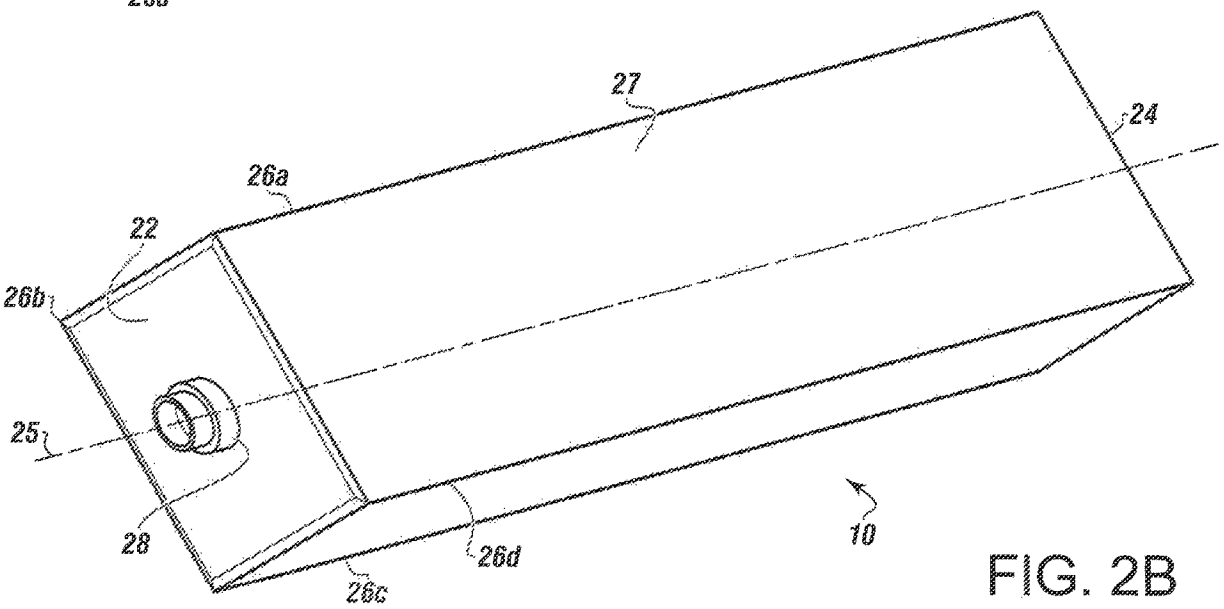
FIG. 2B depicts a top perspective view demonstrating the concept of an expandable multisided vessel in a partially expanded configuration according to one or more embodiments.

FIG. 2B depicts a top perspective view of the expandable multisided vessel 10 in a partially expanded configuration according to one or more embodiments.

The plurality of axial folds 26*a*, 26*b*, 26*c*, and 26*d* can be formed contiguously between the first end 22 and the second end 24 creating a square like shape to the outer wall 27 of the expandable multisided vessel 10.

In this embodiment, the bidirectional port 28 is shown formed in the first end 22 of the partially expanded configuration.

The longitudinal axis 25 is depicted passing through the center of the bidirectional port 28.

Figure 3:
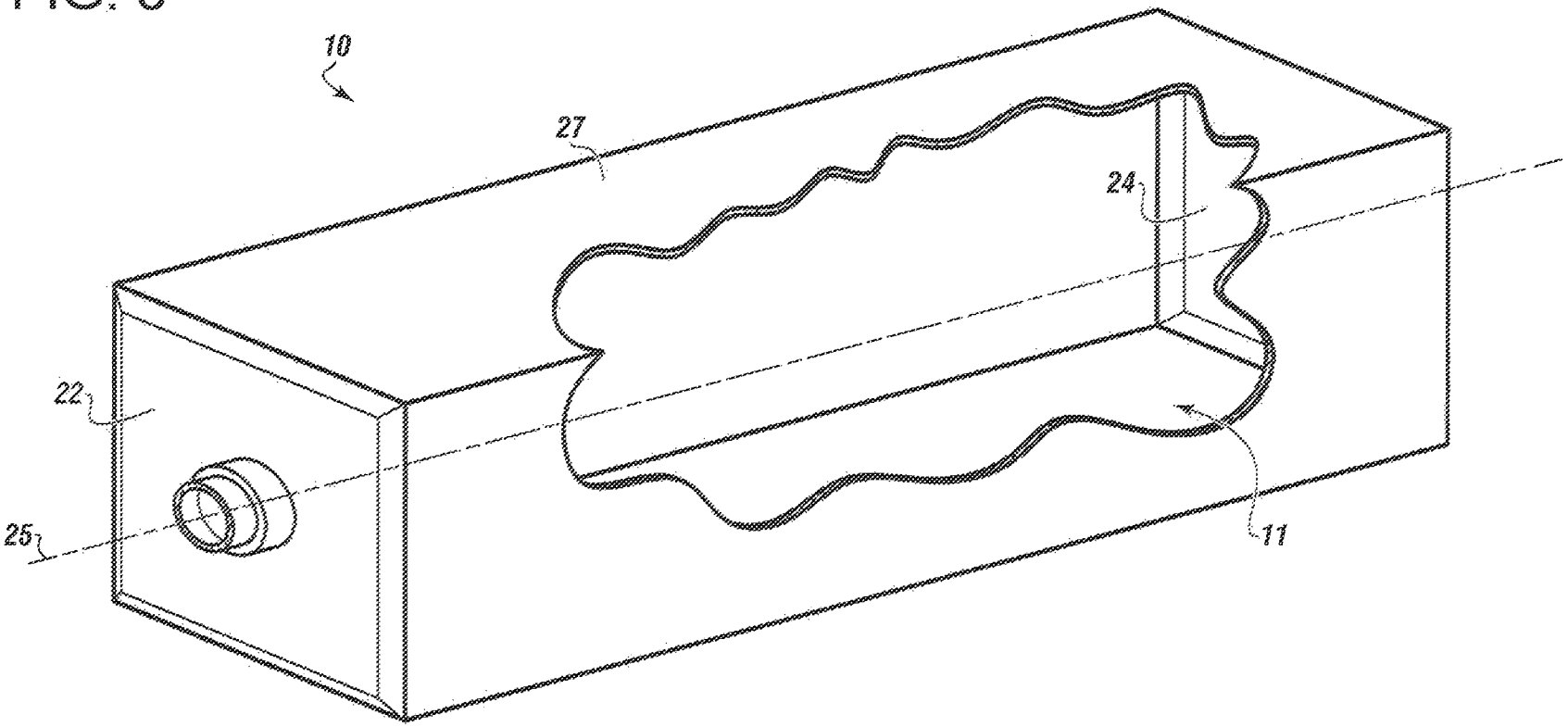
FIG. 3 depicts a partially cut away view of the expandable vessel in the partially expanded configuration according to one or more embodiments.

FIG. 3 depicts a partially cut away view of the expandable vessel 10 with longitudinal axis 25 in the partially expanded configuration according to one or more embodiments.

The expandable vessel 10 is shown with the outer wall 27 and the second end 24 opposite the first end 22. In this embodiment, the pressure containing chamber 11 can be configured to have a contracted pressurized volume and an expanded pressurized volume.

The longitudinal axis 25 is depicted passing through the center of the bidirectional port.

FIGS. 4A-4C depict a view of the expandable multisided vessel 10 in the partially expanded configuration, a side view of the expandable multisided vessel 10 and a cut view of the expandable multisided vessel 10 long cut lines A-A.

The expandable multisided vessel 10 is shown with a moveable flexible rolled metal outer wall 300 and the second end 24 opposite the first end 22.

In embodiments, a pressure containing chamber 11 is configured to have a slightly expanded pressurized volume.

A plurality of axial folds 312*a*-312*e* are shown formed contiguously between the first end 22 and the second end 24.

Each axial fold (internally illustrated as the plurality of axial folds 312*a*-312*e* in FIG. 4C and externally illustrated in FIG. 4A as outer wall axial folds 302 formed at each angle of the pentagon defined by first end 22 and second end 24) joins a portion of the moveable flexible rolled metal outer wall 300 to an adjacent portion, at each of the outer wall axial folds 302.

A plurality of welded plates 306*a*-306*e* are depicted centrally positioned longitudinally on each of the portions of the moveable flexible rolled metal outer wall 300.

FIGS. 5A-5C show an expandable multisided vessel 10 fluidly connected to the bidirectional valve 7 with a first end 22 opposite a second end 24. The expandable multisided vessel has a plurality of axial folds 402*a*-402*f* formed contiguously.

This expandable multisided vessel has a moveable flexible single thickness outer wall 400 having formed and welded outer wall fold.

A plurality of welds 404*a*-404*c* is shown to manufacture the outer wall 400.

A pressure containing chamber 11 is configured to have a contracted pressurized volume and an expanded pressurized volume.

As the expandable multisided vessel 10 receives hydraulic fluid energy from the pressure source, the plurality of axial folds 402*a*-402*f* forming a moveable flexible extruded metal mono thickness outer wall expand away from the longitudinal axis; the contracted volume formed by the a moveable flexible extruded metal mono thickness outer wall increases, increasing stored hydraulic fluid energy in the pressure containing chamber; and as the expandable multisided vessel receives a demand for hydraulic fluid energy from the subsea equipment, the plurality of axial folds 402*a*-402*f* contract towards the longitudinal axis. The expanded volume of the pressure containing chamber reduces releasing stored hydraulic fluid energy, enabling the expandable multisided vessel to store retrievable subsea hydraulic fluid energy in close proximity to the subsea equipment under water and releases the stored hydraulic fluid energy from under water on demand as changes in hydraulic fluid energy requirements for the subsea equipment changes the expandable multisided vessel simultaneously counteracting hydrostatic seawater pressure outside of the a moveable flexible extruded metal dual thickness outer wall with the hydrostatic pressure of hydraulic fluid inside the pressure containing chamber 11.

Figure 6A:
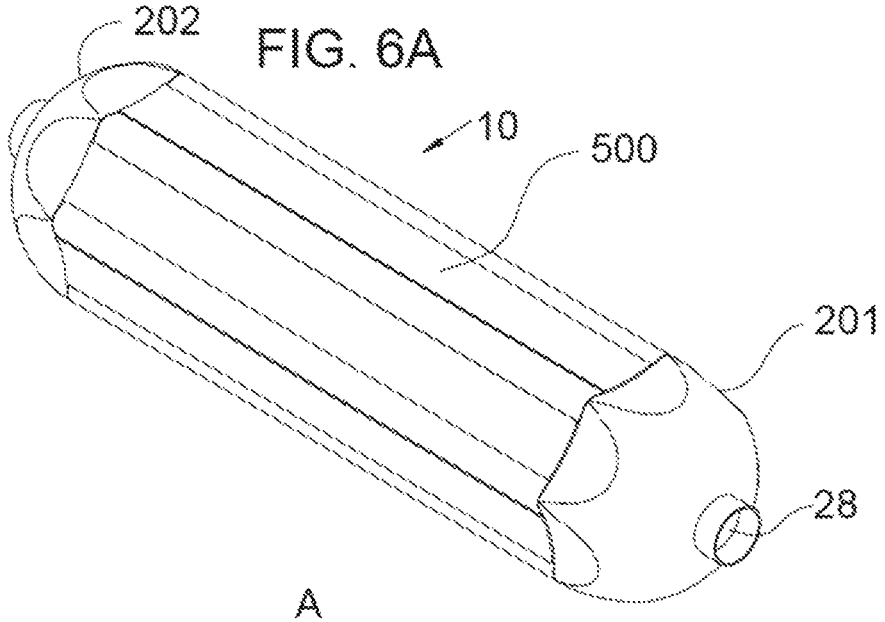
FIGS. 6A, 6B and 6C depict another embodiment of the expandable multisided vessel in a partially expanded configuration according to one or more embodiments.
Figure 6B:
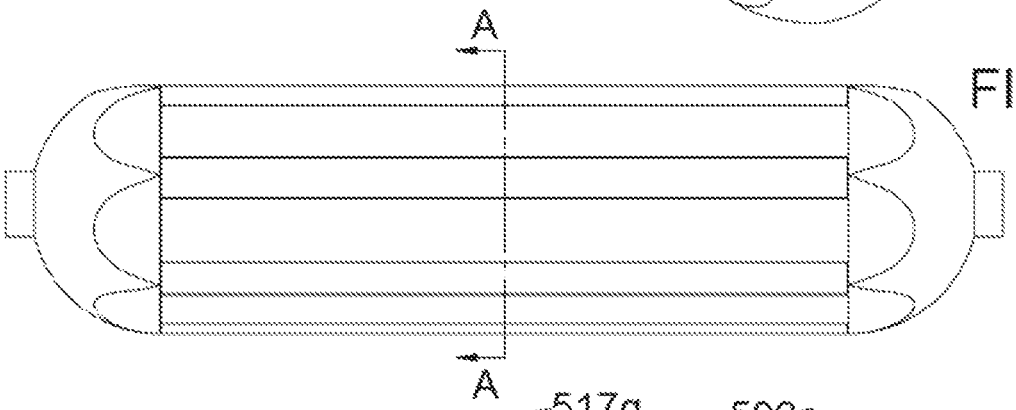
Figure 6C:
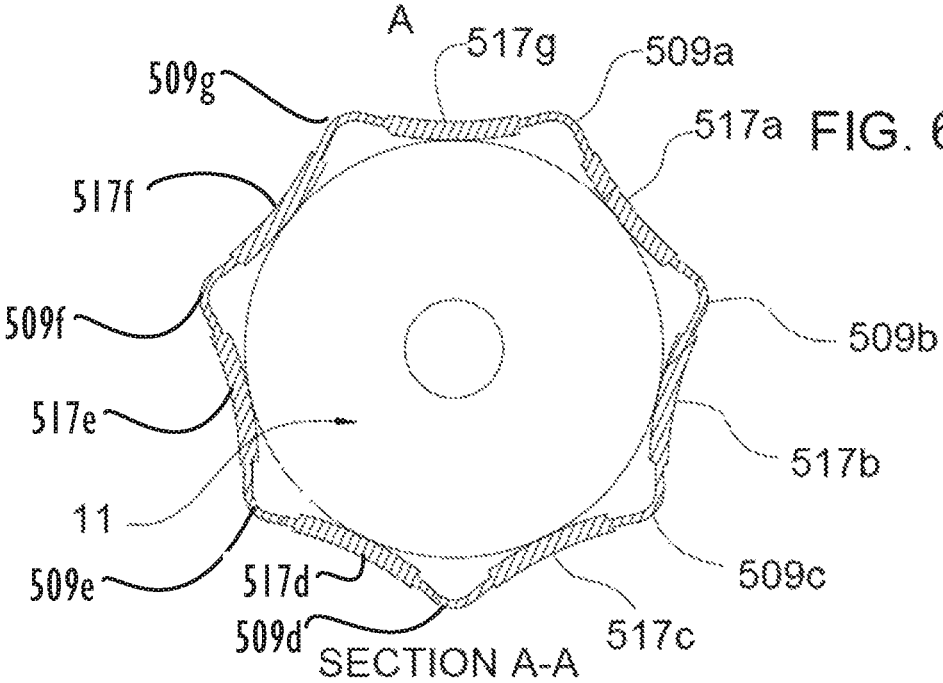

FIGS. 6A-6C show an expandable multisided vessel 10 with a moveable flexible extruded outer wall 500.

A pressure containing chamber 11 is within the outer wall 500, configured to have a contracted pressurized volume and an expanded pressurized volume.

A bidirectional port 28 is formed in the first end or the second end connected to the pressure source and the bidirectional valve, wherein the bidirectional port 28 is configured for flowing through one of the forged end caps 201, 202.

In embodiments, the bidirectional port is configured for flow of hydraulic fluid energy to the bidirectional valve from the pressure containing chamber 11 and a flow of hydraulic fluid energy to the pressure containing chamber 11 from the pressure source.

Axial folds 509*a*-509*g* are depicted when the device is viewed along cut lines A-A.

Metal plates 517*a*-517*g* are shown.

As the expandable multisided vessel 10 receives hydraulic fluid energy from a pressure source, the plurality of axial folds 509*a*-509*g* forming the moveable flexible wound thermoset outer wall expand away from the longitudinal axis; the contracted volume formed by the moveable flexible outer wall increases, increasing stored hydraulic fluid energy in the pressure containing chamber; and as the expandable multisided vessel receives a demand for hydraulic fluid energy from the subsea equipment, the plurality of axial folds contract towards the longitudinal axis. The expanded volume of the pressure containing chamber reduces releasing stored hydraulic fluid energy, enabling the expandable multisided vessel to store retrievable subsea hydraulic fluid energy in close proximity to the subsea equipment under water and release of the stored hydraulic fluid energy from under water on demand as changes in hydraulic fluid energy requirements for the subsea equipment changes the expandable multisided vessel simultaneously counteracting hydrostatic seawater pressure outside of the moveable flexible outer wall with the hydrostatic pressure of hydraulic fluid inside the pressure containing chamber 11.

Figure 7A:
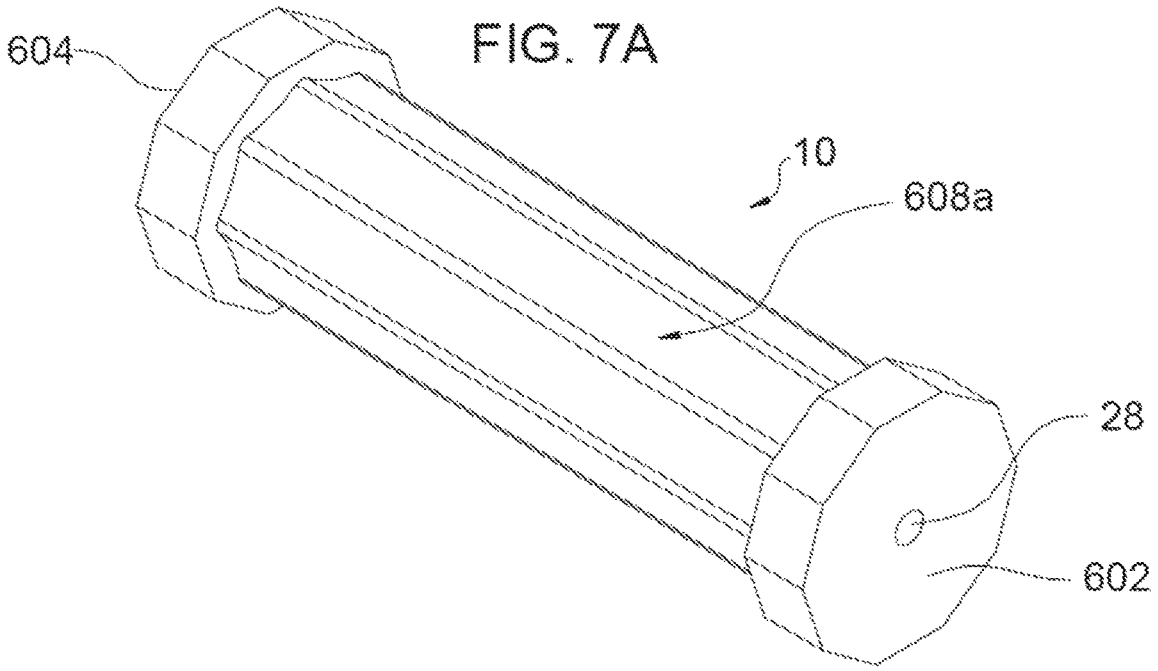
FIGS. 7A, 7B and 7C depict another embodiment of the expandable multisided vessel in a partially expanded configuration according to one or more embodiments.
Figure 7B:
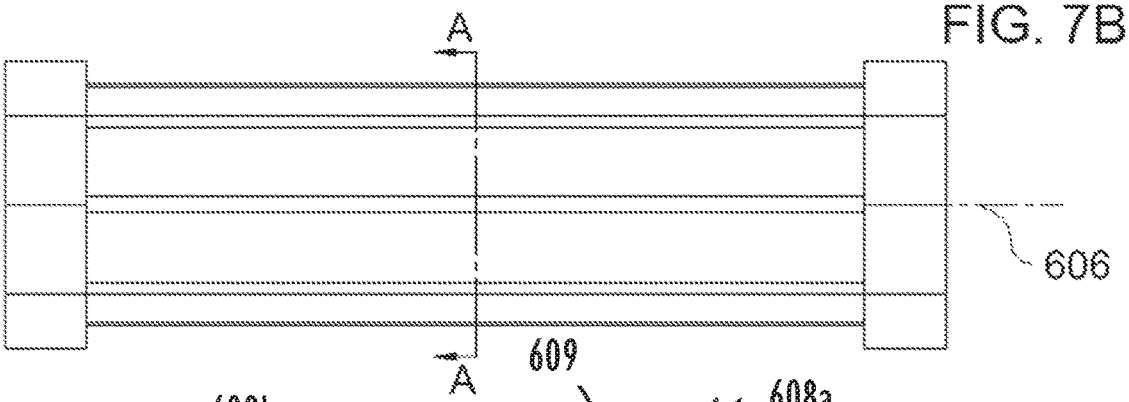
Figure 7C:
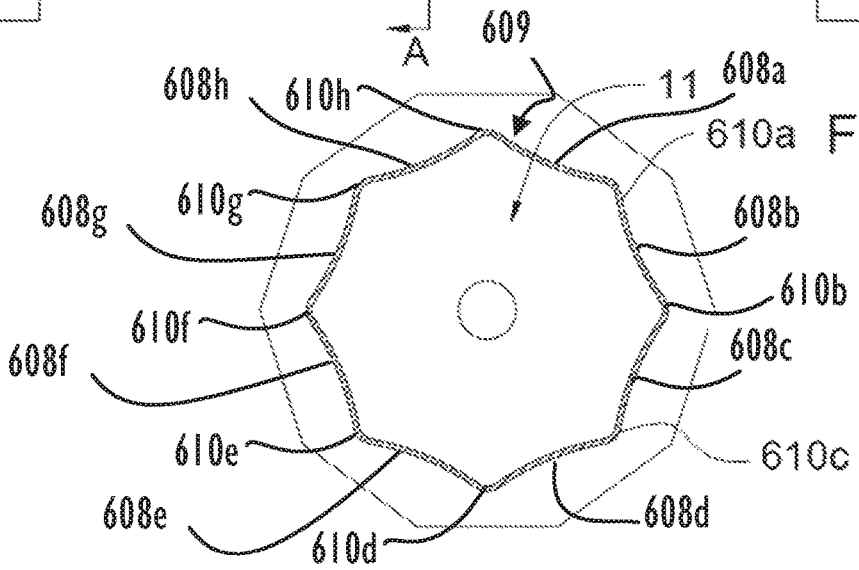

FIGS. 7A-7C show different views of an expandable multisided vessel 10 with a first polygonal end plate 602, a second polygonal end plate 604 opposite the first polygonal end plate 602, a longitudinal axis 606 between the first polygonal end plate 602 and second polygonal end plate 604.

A plurality of axial folds 610*a*-610*h* is formed contiguously between the first and second polygonal end plates 602, 604.

Each axial fold joins portions to form a moveable flexible outer wall 609 (illustrated as the shaped circumference formed from each individual outer wall curve (e.g., 608*a*) and an axial fold on either side of the outer wall curve (e.g., 610*a* and 610*h* are the two axial folds on adjacent sides of outer wall curve 608*a* as illustrated in FIG. 7C)). The shape illustrated in FIG. 7C may be mandrel formed from a pipe (e.g., by pulling a mandrel through a pipe) to create the plurality of outer wall curves 608*a*-608*h*.

A pressure containing chamber 11 configured to have a contracted pressurized volume and an expanded pressurized volume.

A bidirectional port 28 is formed in the first polygonal end plate 602 or the second polygonal end plate 604 connected to the pressure source and the bidirectional valve.

The bidirectional port is configured for a flow of hydraulic fluid energy to the bidirectional valve from the pressure containing chamber and a flow of hydraulic fluid energy from the pressure source to the pressure containing chamber.

As the expandable multisided vessel 10 receives hydraulic fluid energy from the pressure source, the plurality of axial folds forming the moveable flexible outer wall expand away from the longitudinal axis 606; the contracted volume formed by the moveable flexible outer wall increases, increasing stored hydraulic fluid energy in the pressure containing chamber; and as the expandable multisided vessel receives a demand for hydraulic fluid energy from the subsea equipment, the plurality of axial folds contract towards the longitudinal axis. The expanded volume of the pressure containing chamber reduces releasing stored hydraulic fluid energy, enabling the expandable multisided vessel to store retrievable subsea hydraulic fluid energy in close proximity to the subsea equipment under water and releasing the stored hydraulic fluid energy from under water on demand as changes in hydraulic fluid energy requirements for the subsea equipment changes the expandable multisided vessel simultaneously counteracting hydrostatic seawater pressure outside of the moveable flexible outer wall with the hydrostatic pressure of hydraulic fluid inside the pressure containing chamber 11.

Figure 8A:
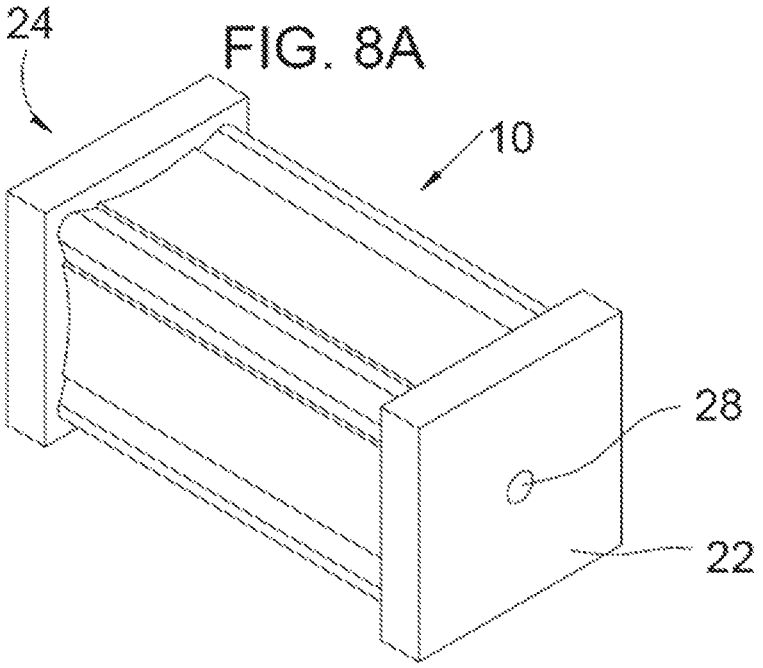
FIGS. 8A, 8B and 8C depict another embodiment of the expandable multisided vessel in a partially expanded configuration according to one or more embodiments.
Figure 8B:
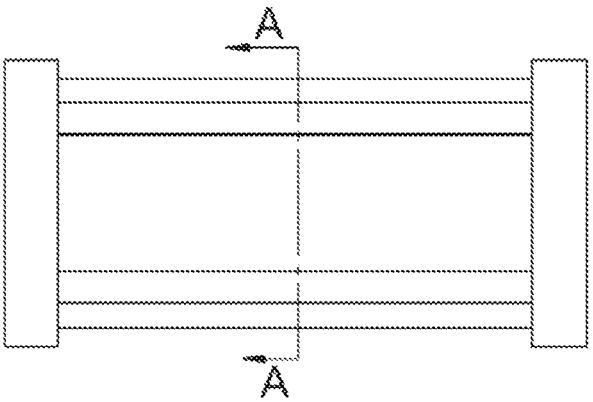
Figure 8C:
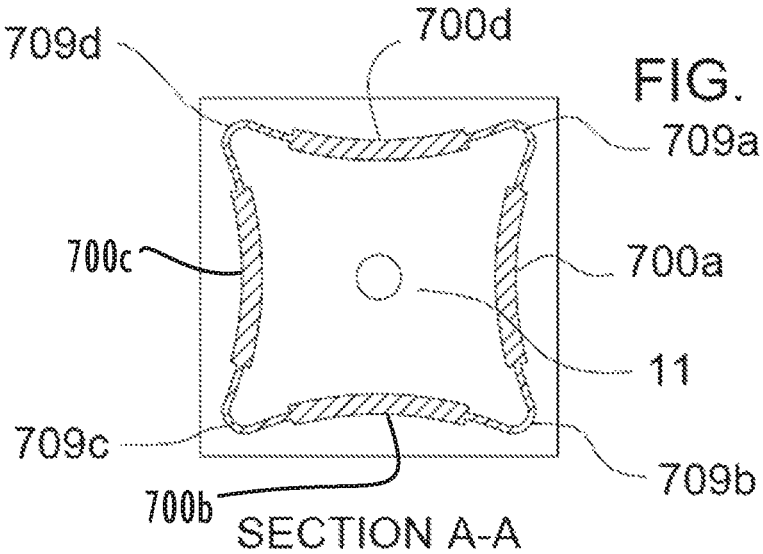

FIGS. 8A-8C show an expandable multisided vessel 10 having a first end 22; a second end 24 opposite the first end, 22 a plurality of axial folds 709*a*-709*d* formed contiguously between the first end 22 and the second end 24.

Each axial fold joins a portion to form a moveable flexible laid thermoset outer wall (e.g., the axial fold may be formed using a laid thermoset application technique to create the outer wall as illustrated in FIGS. 8A-8C). And a plurality of reinforcing flexible laid thermoset segments 700*a*-700*d* when viewed in cross section along lines A-A.

A pressure containing chamber 11 is configured to have a contracted pressurized volume and an expanded pressurized volume.

A bidirectional port is formed in the first end 22 or the second end 24 connected to the pressure source and the bidirectional valve. The bidirectional port is configured for a flow of hydraulic fluid energy to the bidirectional valve from the pressure containing chamber and a flow of hydraulic fluid energy to the pressure containing chamber from the pressure source.

As in other embodiments, as the expandable multisided vessel receives hydraulic fluid energy from the pressure source, the plurality axial folds forming the moveable flexible outer wall expands away from the longitudinal axis; the contracted volume formed by the a moveable flexible outer wall increases, increasing stored hydraulic fluid energy in the pressure containing chamber; and as the expandable multisided vessel receives a demand for hydraulic fluid energy from the subsea equipment, the plurality of axial folds contract towards the longitudinal axis. The expanded volume of the pressure containing chamber reduces, releasing stored hydraulic fluid energy, enabling the expandable multisided vessel to store retrievable subsea hydraulic fluid energy in close proximity to the subsea equipment under water, and releasing the stored hydraulic fluid energy from under water on demand as changes in hydraulic fluid energy requirements for the subsea equipment changes, the expandable multisided vessel simultaneously counteracting hydrostatic seawater pressure outside of the moveable flexible laid thermoset outer wall with the hydrostatic pressure of hydraulic fluid inside the pressure containing chamber 11.

Figure 9A:
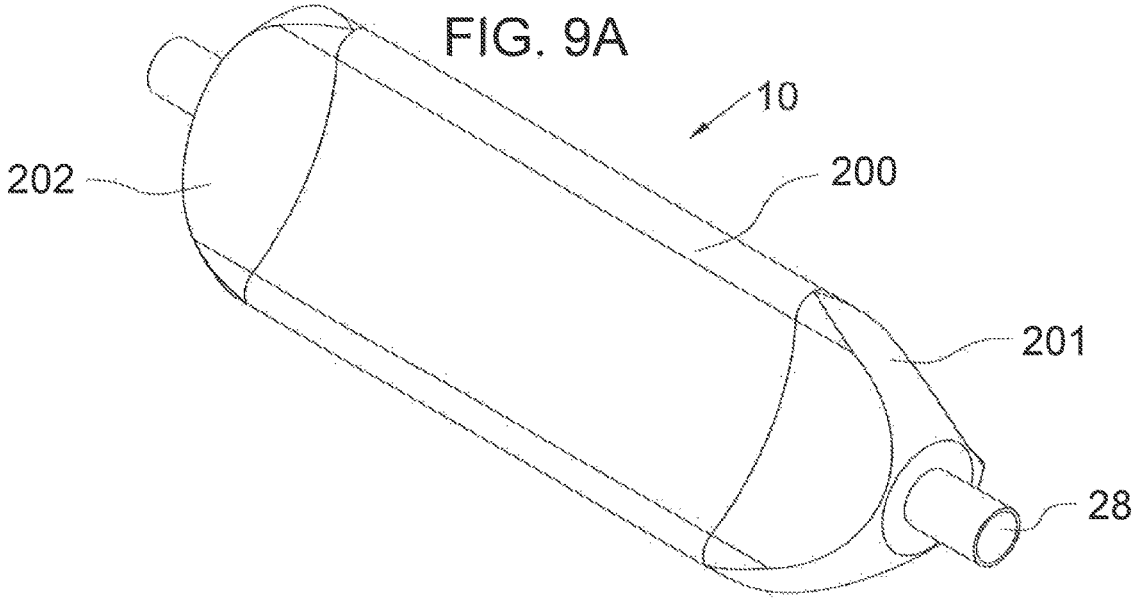
FIGS. 9A, 9B and 9C depict another embodiment of the expandable multisided vessel in a partially expanded configuration according to one or more embodiments.
Figure 9B:
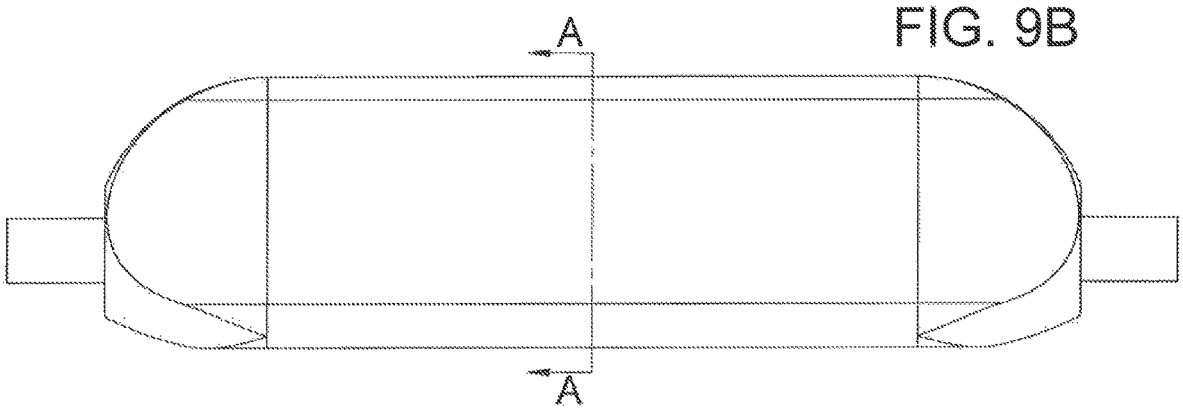
Figure 9C:
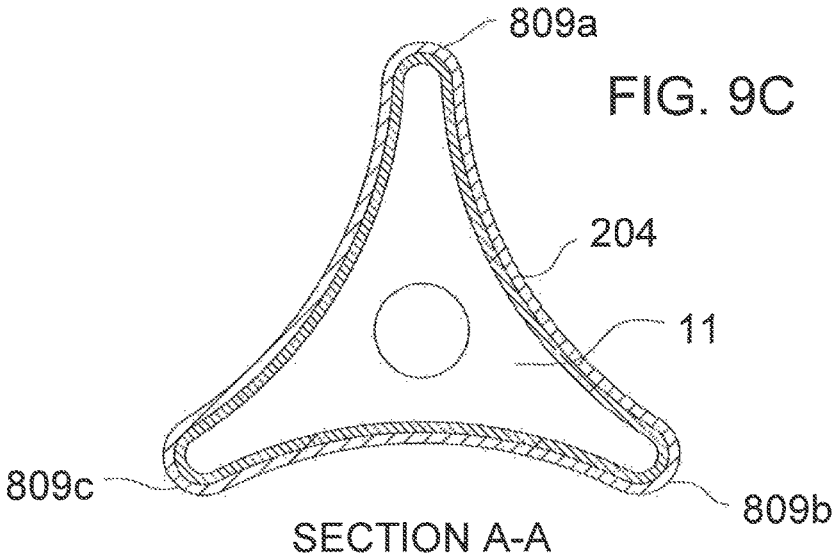

FIGS. 9A-9C show an expandable multisided vessel 10 with a moveable flexible wound thermoset outer wall 200 (e.g., the outer wall 200 may be formed using a wound thermoset application technique to create the outer wall as illustrated in FIGS. 9A-9C) with a hydroformed metal liner 204 or a thermoplastic liner of a flexible material lining the inner surface.

A pressure containing chamber 11 is within the liner 204, configured to have a contracted pressurized volume and an expanded pressurized volume.

A bidirectional port 28 is formed in the first end or the second end connected to the pressure source and the bidirectional valve, wherein the bidirectional port 28 is configured for flowing through one of the end caps 201 or 202.

In embodiments, the bidirectional port 28 is configured for flow of hydraulic fluid energy to the bidirectional valve from the pressure containing chamber 11 and a flow of hydraulic fluid energy to the pressure containing chamber 11 from the pressure source.

Axial folds 809*a*-809*c* are depicted when the device is viewed along cut lines A-A.

As the expandable multisided vessel 10 receives hydraulic fluid energy from a pressure source, the plurality of axial folds 809*a*-809*c* forming the moveable flexible wound thermoset outer wall expand away from the longitudinal axis; the contracted volume formed by the moveable flexible wound thermoset outer wall increases, increasing stored hydraulic fluid energy in the pressure containing chamber; and as the expandable multisided vessel receives a demand for hydraulic fluid energy from the subsea equipment, the plurality of axial folds contract towards the longitudinal axis. The expanded volume of the pressure containing chamber reduces releasing stored hydraulic fluid energy, enabling the expandable multisided vessel to store retrievable subsea hydraulic fluid energy in close proximity to the subsea equipment under water and release of the stored hydraulic fluid energy from under water on demand as changes in hydraulic fluid energy requirements for the subsea equipment changes the expandable multisided vessel simultaneously counteracting hydrostatic seawater pressure outside of the moveable flexible wound thermoset outer wall with the hydrostatic pressure of hydraulic fluid inside the pressure containing chamber 11.

A typical subsea piston actuated gate valve will need local accumulation to prevent sympathetic closure of other valves on the same piece of subsea equipment when it is opened. The sympathetic closure is caused by the combination of fail-safe valve construction and pipe period.

Subsea valves are designed to fail-safe and not latch; i.e. they have to be held in position with pressure and will start to close if there is any reduction in local pressure below that required to hold them open. An example valve will start to open at 500 psi and be fully open at 1,000 psi. If there is already one valve open and there is no other pressure source, a command to open a second valve will cause the two valves to equalize at 50 percent open and 750 psi, also called "sympathetic closure".

The low pressure, such as 500 psi start to open, caused by commanding a valve open travels at the speed of sound; typically 1 second to 5 seconds per mile depending on the control fluid and tubing wall design. This low pressure impulse travels from the valve to the pressure source and back again before fluid begins to flow into the actuator from the pressure source and is also called the "pipe period"; i.e. the pipe period equals the offset distance/half the speed of sound.

Given an average pipe period of 6 seconds per mile and typical valve travel period of 20 seconds from closed to open; any valve that is operated at distances greater than 3 miles to 4 miles from the pressure source will complete its opening before fluid begins to flow into it from the remote pressure source. Partially open valves will cause excessive wear to the valve by rubbing against seals and allowing the produced fluids to cut the gate. This valve wear causes the valve to leak and can lead to excessive discharge of reservoir fluids to the sea in the event of the loss of containment. Worn valves must be replaced at extremely high cost due to their location on the seafloor and criticality to safe operation.

A typical control system will have an operating pressure of 5,000 psi. Therefore, a local accumulator can be sized to have sufficient usable volume to fill the largest valve actuator on the subsea equipment while maintaining a minimum of 1,000 psi and thereby preventing sympathetic closure of other valves.

In embodiments, the expandable multisided vessel when partially expanded can have a square shape or other shapes as shown in the Figures.

In other embodiments, the expandable multisided vessel when fully expanded can have a round shape.

The expandable multisided vessel can be expandable and retracted, expanding from the contracted state, to the square state, to the round state, back to the square state, and then to the contracted state.

The expandable multisided vessel can be from 1 foot to 20 feet long, with an initial diameter of 4 inches to 24 inches in diameter.

The thickness of the outer wall of the expandable multisided vessel can vary from 1/16th of an inch to 6 inches, depending on the pressure source operating pressure.

In embodiments, the expandable multisided vessel can be a one-piece construction of steel, such as stainless steel or "spring steel" which can be a high strength steel, capable of sustaining 50 ksi.

In embodiments, the expandable multisided vessel can be made from a first material for the first and second ends, and a second material for the plurality of axial folds. In embodiments, the first and second ends can be formed from a galvanic compatible material and the plurality of axial folds can be formed from the "spring steel" such as grade ASTM Grade A666 spring steel.

In embodiments, the controller can be remotely controlled from a client device connected to a network that further communicates with the controller, such as a laptop, a computer, a cellular phone, a tablet, or a similar device.

In embodiments, as the plurality of axial folds expand away from the longitudinal axis, the contracted volume of the pressure containing chamber expands towards an expanded volume increasing stored hydraulic fluid energy in the pressure containing chamber. In embodiments, the plurality of axial folds can expand away from the longitudinal axis from 0.001 of a percent to 20 percent of the overall diameter of the expandable multisided vessel.

In embodiments, the expansion of the plurality of axial folds can occur in milliseconds. Similarly, the contraction of the plurality of axial folds can occur in milliseconds.

Similarly, as the plurality of axial folds contract towards the longitudinal axis, the expanded volume of the pressurized chamber reduces releasing stored hydraulic fluid energy, enabling the expandable multisided vessel to store retrievable subsea hydraulic fluid energy in close proximity to the subsea equipment and release the stored hydraulic fluid energy on demand as changes in hydraulic fluid energy requirements for the subsea equipment changes, while the expandable muitisided vessel simultaneously counteracts the hydrostatic seawater pressure of seawater outside of the expandable multisided vessel with the hydrostatic pressure of hydraulic fluid inside the pressurized chamber. In embodiments, the plurality of axial folds can retract from 0.001 of a percent to 20 percent of the overall diameter of the expandable multi sided vessel.

The plurality of axial folds can expand and retract without frictional losses.

While these embodiments have been described with emphasis on the embodiments, it should be understood that within the scope of the appended claims, the embodiments might be practiced other than as specifically described herein.

What is claimed is:

1. A self-contained expandable automatic pressure compensated accumulator system for storing and releasing hydraulic fluid energy for use by subsea equipment under water, the self-contained expandable automatic pressure compensated accumulator system comprising:

a controller;

a pressure source connected to the controller for supplying hydraulic fluid at a defined pressure as hydraulic fluid energy;

a bidirectional valve connected both fluidly to the pressure source for transmitting the hydraulic fluid energy to the subsea equipment and electrically to the controller for controlling the hydraulic fluid energy to and from the subsea equipment based on commands from the controller; and an expandable multisided vessel fluidly connected to the bidirectional valve, the expandable multisided vessel comprising:

a first end;

a second end opposite the first end;

a longitudinal axis between the first end and the second end;

a bidirectional port formed in the first end or the second end, the bidirectional port for fluid connection to both the bidirectional valve to control subsea equipment and the pressure source for supplying hydraulic fluid to a pressure containing chamber configured to have a contracted pressurized volume and an expanded pressurized volume; and a flexible outer wall formed from a first number of sides and a first number of axial folds formed contiguously between the first end and the second end, each of the sides joined to each of a first directly adjacent side and a second directly adjacent side by respective axial folds of the number of axial folds, the flexible outer wall having an inner surface surrounding the pressure containing chamber and an exposed outer surface, the transition of the pressure containing chamber from contracted pressurized volume to expanded pressurized volume realized by frictionless movement of the first number of sides away from the longitudinal axis and flexing of the first number of axial folds, wherein, as the expandable multisided vessel system receives the hydraulic fluid from the pressure source into the pressure containing chamber a hydraulic fluid energy is stored within the pressure containing chamber, and responsive to a demand for the hydraulic fluid energy from the subsea equipment, the first number of sides contract toward the longitudinal axis to release the stored hydraulic fluid energy to control the subsea equipment; and wherein, in use, the expandable multisided vessel system stores the hydraulic fluid energy while simultaneously counteracting hydrostatic seawater pressure applied directly on the exposed outer surface of the flexible outer wall caused by external pressure of seawater on the exposed outer surface of the flexible outer wall.

2. The self-contained expandable automatic pressure compensated accumulator system of claim 1, wherein the first number of axial folds comprises from 2 folds to 20 folds.

3. The self-contained expandable automatic pressure compensated accumulator system of claim 1, wherein the subsea equipment is at least one of: a blowout preventer, a tubular, a subsea Christmas trees, and a subsea manifold.

4. A self-contained expandable automatic pressure compensated accumulator system for storing and releasing hydraulic fluid energy for use by subsea equipment, the self-contained expandable automatic pressure compensated accumulator system comprising:

a controller;

a pressure source connected to the controller for supplying hydraulic fluid at a defined pressure as hydraulic fluid energy;

a bidirectional valve connected:

fluidly to the pressure source for transmitting the hydraulic fluid energy to subsea equipment; and electrically to the controller for controlling the hydraulic fluid energy to and from the subsea equipment based on commands from the controller; and an expandable multisided vessel fluidly connected to the bidirectional valve, the expandable multisided vessel comprising:

a first bell endplate;

a second bell endplate opposite the first bell end plate;

a longitudinal axis between the first and second bell endplates;

a plurality of axial folds formed contiguously between the first and second bell endplates creating a moveable flexible extruded metal dual thickness outer wall, the outer wall surrounding a pressure containing chamber configured to have a contracted pressurized volume and an expanded pressurized volume; and a bidirectional port formed in the first bell endplate or the second bell endplate connected to the pressure source and the bidirectional valve, wherein the bidirectional port is configured for both a flow of the hydraulic fluid energy to the bidirectional valve from the pressure containing chamber and a flow of the hydraulic fluid energy from the pressure source to the pressure containing chamber, wherein, as the expandable multisided vessel receives the hydraulic fluid energy from the pressure source:

the plurality of axial folds, forming the moveable flexible extruded metal dual thickness outer wall, expand away from the longitudinal axis, the contracted volume, formed by the moveable flexible extruded metal dual thickness outer wall increases, increases the stored hydraulic fluid energy in the pressure containing chamber; and wherein as the expandable multisided vessel receives a demand for the hydraulic fluid energy from the subsea equipment:

the plurality of axial folds contract towards the longitudinal axis, the expanded volume of the pressure containing chamber reduces via releasing stored hydraulic fluid energy, enabling the expandable multisided vessel to store retrievable subsea hydraulic fluid energy in close proximity to the subsea equipment under water, and wherein, as part of the releasing stored hydraulic fluid energy from under water on demand as changes in hydraulic fluid energy requirements for the subsea equipment changes, the expandable multisided vessel simultaneously counteracts hydrostatic seawater pressure applied directly on an exposed outer surface of the a moveable flexible extruded metal dual thickness outer wall with hydrostatic pressure of hydraulic fluid inside the pressure containing chamber.

5. A self-contained expandable automatic pressure compensated accumulator system for storing and releasing hydraulic fluid energy for use by subsea equipment, the self-contained expandable automatic pressure compensated accumulator system comprising:

a controller;

a pressure source connected to the controller for supplying hydraulic fluid at a defined pressure as hydraulic fluid energy;

a bidirectional valve connected both fluidly to the pressure source for transmitting the hydraulic fluid energy to subsea equipment and electrically to the controller for controlling the hydraulic fluid energy to and from the subsea equipment based on commands from the controller; and an expandable multisided vessel fluidly connected to the bidirectional valve, the expandable multisided vessel comprising a first polygonal metal end plate;

a second polygonal metal end plate opposite the first polygonal metal end plate;

a longitudinal axis between the first and second polygonal metal end plates;

a plurality of axial folds forming a moveable flexible outer wall contiguously between the first and second polygonal metal end plates, the moveable flexible outer wall surrounding a pressure containing chamber configured to have a contracted pressurized volume and an expanded pressurized volume; and a bidirectional port, formed in the first polygonal metal end plate or the second polygonal metal end plate, connected to the pressure source and the bidirectional valve, wherein the bidirectional port is configured for:

a flow of the hydraulic fluid energy to the bidirectional valve from the pressure containing chamber; and a flow of the hydraulic fluid energy from the pressure source to the pressure containing chamber; and wherein, as the expandable multisided vessel receives the hydraulic fluid energy from the pressure source:

the plurality of axial folds forming the moveable flexible outer wall expand away from the longitudinal axis, the contracted volume formed by the moveable flexible outer wall increases, increasing the stored hydraulic fluid energy in the pressure containing chamber; and wherein, as the expandable multisided vessel receives a demand for the hydraulic fluid energy from the subsea equipment:

the plurality of axial folds contract towards the longitudinal axis, the expanded volume of the pressure containing chamber reduces releasing stored hydraulic fluid energy, enabling the expandable multisided vessel to store retrievable subsea hydraulic fluid energy in close proximity to the subsea equipment under water, and wherein, as part of the releasing stored hydraulic fluid energy, the expandable multisided vessel simultaneously counteracts hydrostatic seawater pressure outside of the moveable flexible outer wall with the hydrostatic pressure of hydraulic fluid inside the pressure containing chamber.

* * * * *